US011783991B2

(12) United States Patent
Yen et al.

(10) Patent No.: US 11,783,991 B2
(45) Date of Patent: Oct. 10, 2023

(54) INDUCTOR DEVICE

(71) Applicant: Realtek Semiconductor Corporation, Hsinchu (TW)

(72) Inventors: Hsiao-Tsung Yen, Hsinchu (TW); Ka-Un Chan, Zhubei (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 323 days.

(21) Appl. No.: 17/005,381

(22) Filed: Aug. 28, 2020

(65) Prior Publication Data

US 2021/0065966 A1 Mar. 4, 2021

(30) Foreign Application Priority Data

Aug. 29, 2019 (TW) ..... 108131123

(51) Int. Cl.
*H01F 27/28* (2006.01)
*H01F 27/29* (2006.01)

(52) U.S. Cl.
CPC ..... *H01F 27/29* (2013.01); *H01F 27/2823* (2013.01)

(58) Field of Classification Search
CPC ..... H01F 27/28
USPC ..... 336/200, 225
See application file for complete search history.

(56) References Cited

U.S. PATENT DOCUMENTS 8,044,759 B2 * 10/2011 Yang ..... H01F 19/04 336/200
10,153,078 B2 12/2018 Yen et al.
2014/0077919 A1 * 3/2014 Godoy ..... H01F 30/08 336/226
2019/0221350 A1 7/2019 Yen et al.
2019/0279809 A1 9/2019 Yen
2019/0392980 A1 12/2019 Yen

FOREIGN PATENT DOCUMENTS

CN 106030730 A 10/2016
TW 201428783 A 7/2014
TW I645426 B 12/2018
TW I659437 B 5/2019

OTHER PUBLICATIONS

China Patent Office, "Office Action", dated Oct. 8, 2021, China.

* cited by examiner

*Primary Examiner* — Ronald Hinson
(74) *Attorney, Agent, or Firm* — Locke Lord LLP; Tim Tingkang Xia, Esq.

(57) ABSTRACT

An inductor device includes a first inductor and a second inductor. The first inductor has a first winding and a second winding. The second inductor has a third winding and a fourth winding, and the second inductor is disposed adjacent to the first inductor, and the second inductor is coupled to the first inductor in an interlaced manner.

18 Claims, 4 Drawing Sheets

INDUCTOR DEVICE

RELATED APPLICATIONS

This application claims priority to Taiwan Application Serial Number 108131123, filed Aug. 29, 2019, which is herein incorporated by reference.

BACKGROUND OF THE INVENTION

Field of Invention

The present disclosure relates to basic electronical elements. More particularly, the present disclosure relates to an inductor device.

Description of Related Art

With the miniaturization of electronic products and the frequency adopted by the integrated circuit being increasingly higher (i.e., a millimeter wave), the inductor used for communication also decreases in size. In such size limitations, the coupling phenomenon or interference is much worse than before, significantly affecting the quality factor (Q) of such integrated inductor.

SUMMARY

One aspect of the present disclosure is directed to an inductor device, and the inductor device comprises a first inductor and a second inductor. The first inductor has a first winding and a second winding. The second inductor has a third winding and a fourth winding, and the second inductor is disposed adjacent to the first inductor, and the second inductor is coupled to the first inductor in an interlaced manner.

In view of the above embodiments of the present disclosure, it is apparent that the application of the present invention has the advantages as follows. Embodiments of the present disclosure provide an inductor device so that the impact to the quality factor of the inductor device, which is introduced by the coupling phenomenon from every direction (i.e., X, Y directions), can be reduced.

DETAILED DESCRIPTION

Figure 1:
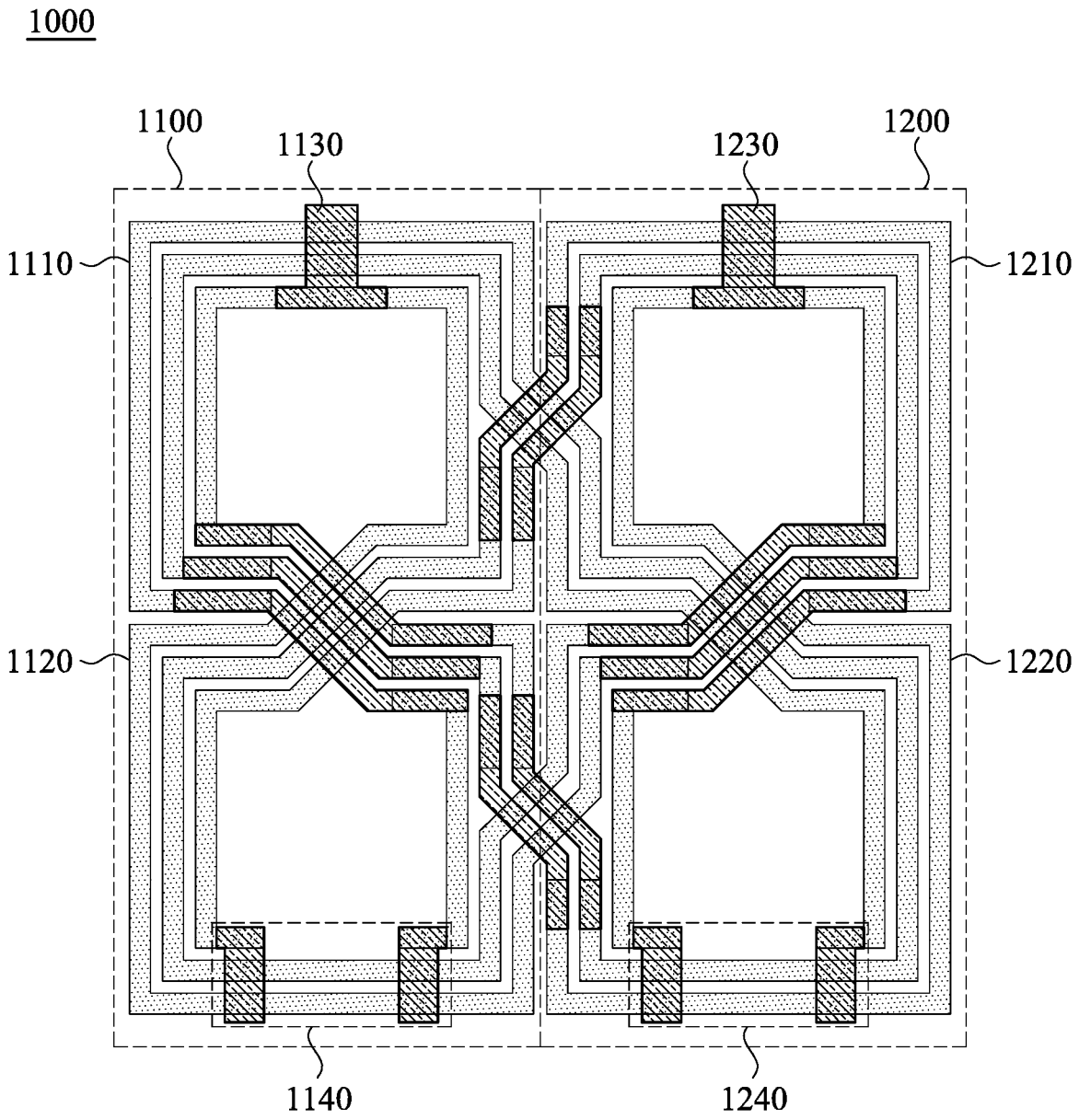
FIG. 1 is a schematic diagram of an inductor device according to some embodiments of the present disclosure.

FIG. 1 is a schematic diagram of an inductor device 1000 according to some embodiments of the present disclosure. As shown in the figure, the inductor device 1000 includes a first inductor 1100 and a second inductor 1200. The first inductor 1100 is disposed adjacent to the second inductor 1200, and the first inductor 1100 and the second inductor 1200 are coupled to each other in an interlaced manner. For example, there are crossing structures among the first inductor 1100 and the second inductor 1200, and the first inductor 1100 and the second inductor 1200 are coupled to each other by the crossing structures. Specifically, the crossing structure has a connection element, and a crossing element. The connection element, which is located at a lower layer, connects the first inductor 1100 and the second inductor 1200, which are located at the lower layer. Besides, the crossing element, which is located at an upper layer and crosses the connection element, connects the first inductor 1100 and the second inductor 1200 located at the lower layer by vias.

In some embodiments, the first inductor 1100 can be a first 8-shaped inductor, and the second inductor 1200 can be a second 8-shaped inductor.

In one embodiment, the first inductor 1100 includes a first winding 1110 and a second winding 1120, and the second inductor 1200 includes a third winding 1210 and a fourth winding 1220. With respect to structures, the first winding 1110 and the third winding 1210 are coupled to each other at a first side (i.e., the upper side/the top half part) of the inductor device 1000 in an interlaced manner, and the second winding 1120 and the fourth winding 1220 are coupled to each other at a second side (i.e., the lower side/the bottom half part) of the inductor device 1000 in an interlaced manner. In another embodiment, the first side (i.e., the upper side/the top half part) of the inductor device 1000 is relatively positioned with respect to the second side (i.e., the lower side/the bottom half part) of the inductor device 1000.

In still another embodiment, the first winding 1110 and the second winding 1120 of the first inductor 1100 are coupled to each other in an interlaced manner, and the third winding 1210 and the fourth winding 1220 of the second inductor 1200 are coupled to each other in an interlaced manner.

In one embodiment, the first inductor 1100 further includes a first center tap 1130, and the second inductor 1200 further includes a second center tap 1230. The first center tap 1130 of the first inductor 1100 and the second center tap 1230 of the second inductor 1200 are disposed at the first side (i.e., the upper side). In another embodiment, the first center tap 1130 of the first inductor 1100 is coupled to an inner side of the first winding 1110, and the second center tap 1230 of the second inductor 1200 is coupled to an inner side of the third winding 1210. However, the present disclosure is not intended to be limited to the embodiment, the configuration of the first inductor 1100 and the second inductor 1200 can be arranged depending on actual requirements, and the center tap can be disposed corresponding to the above-mentioned configuration.

In another embodiment, the first inductor 1100 further includes a first input terminal 1140, and the second inductor 1200 further includes a second input terminal 1240. The first input terminal 1140 of the first inductor 1100 and the second input terminal 1240 of the second inductor 1200 are disposed at a second side (i.e., the lower side). In still another embodiment, the first input terminal 1140 of the first inductor 1100 is disposed at an inner side of the second winding 1120, and the second input terminal 1240 of the second inductor 1200 is disposed at an inner side of the fourth winding 1220. However, the present disclosure is not intended to be limited to the embodiment, the first input terminal 1140 can be disposed at the left side of the second winding 1120, and the second input terminal 1240 can be disposed at the right side of the fourth winding 1220 depending on actual requirements. In addition, the configuration of the first inductor 1100 and the second inductor 1200 can be arranged depending on actual requirements, and the input terminal can be disposed corresponding to the above-mentioned configuration.

In one embodiment, each of the first winding 1110 and the second winding 1120 of the first inductor 1100 is winded to form a plurality of wires. The wires of the first winding 1110 and the wires of the second winding 1120 are coupled to each other at the middle of the first inductor 1100 in an interlaced manner. For example, each of the first winding 1110 and the second winding 1120 is winded to form three wires, and the above-mentioned three wires are coupled to each other in an interlaced manner. In another embodiment, each of the third winding 1210 and the fourth winding 1220 of the second inductor 1200 is winded to form a plurality of wires. The wires of the third winding 1210 and the wires of the fourth winding 1220 are coupled to each other at the middle of the second inductor 1200 in an interlaced manner. For example, each of the third winding 1210 and the fourth winding 1220 is winded to form three wires, and the above-mentioned three wires are coupled to each other in an interlaced manner.

In another embodiment, a portion of first winding 1110 of the first inductor 1100 and a portion of third winding 1210 of the second inductor 1200 are coupled to each other in an interlaced manner. For example, each of the first winding 1110 and the third winding 1210 is winded to form three wires. However, only two of the wires are coupled to each other in an interlaced manner. In still another embodiment, a portion of second winding 1120 of the first inductor 1100 and a portion of fourth winding 1220 of the second inductor 1200 are coupled to each other in an interlaced manner. For example, each of the second winding 1120 and the fourth winding 1220 is winded to form three wires. However, only two of the wires are coupled to each other in an interlaced manner.

In one embodiment, when current flows through the input terminal into the first inductor 1100 and the second inductor 1200, the current flows inside the first, the second windings 1110, 1120 of the first inductor 1100 and the third, the fourth windings 1210, 1220 of the second inductor 1200. The flowing direction of the current will be described below. The directions of currents of two of the first winding 1110, the second winding 1120, the third winding 1210 and the fourth winding 1220, which are disposed at the same side, are opposite to each other. For example, the first winding 1110 and the second winding 1120 are both disposed at the left side, and the flowing directions of the currents of the first winding 1110 and the second winding 1120 are opposite to each other. The third winding 1210 and the fourth winding 1220 are both disposed at the right side, and the flowing directions of the currents of the third winding 1210 and the fourth winding 1220 are the opposite to each other. The first winding 1110 and the third winding 1210 are both disposed at the upper side, and the flowing directions of the currents of the first winding 1110 and the third winding 1210 are opposite to each other. The second winding 1120 and the fourth winding 1220 are both disposed at the lower side, and the flowing directions of the currents of the second winding 1120 and the fourth winding 1220 are opposite to each other.

For example, the flowing direction of the current of the first winding 1110 is counter-clockwise, the flowing direction of the current of the second winding 1120 is clockwise, the flowing direction of the current of the third winding 1210 is clockwise, and the flowing direction of the current of the fourth winding 1220 is counter-clockwise. Therefore, the flowing directions of the currents of the first winding 1110 and the second winding 1120 are opposite to each other, the flowing directions of the currents of the third winding 1210 and the fourth winding 1220 are opposite to each other. Besides, from another point of view, the flowing directions of the currents of the first winding 1110 and the third winding 1210 are opposite to each other, and the flowing directions of the currents of the second winding 1120 and the fourth winding 1220 are opposite to each other.

In view of above, since the inductor device 1000 in FIG. 1 adopts two 8-shaped inductors which are disposed with each other side by side, the impact to the quality factor of the inductor device 1000, which is introduced by the coupling phenomenon from every direction, can be reduced, and the configuration of the input terminal and the center tap in the inductor device 1000 can be arranged flexibly so that the design and the manufacture of the inductor device 1000 can be convenient.

Figure 2:
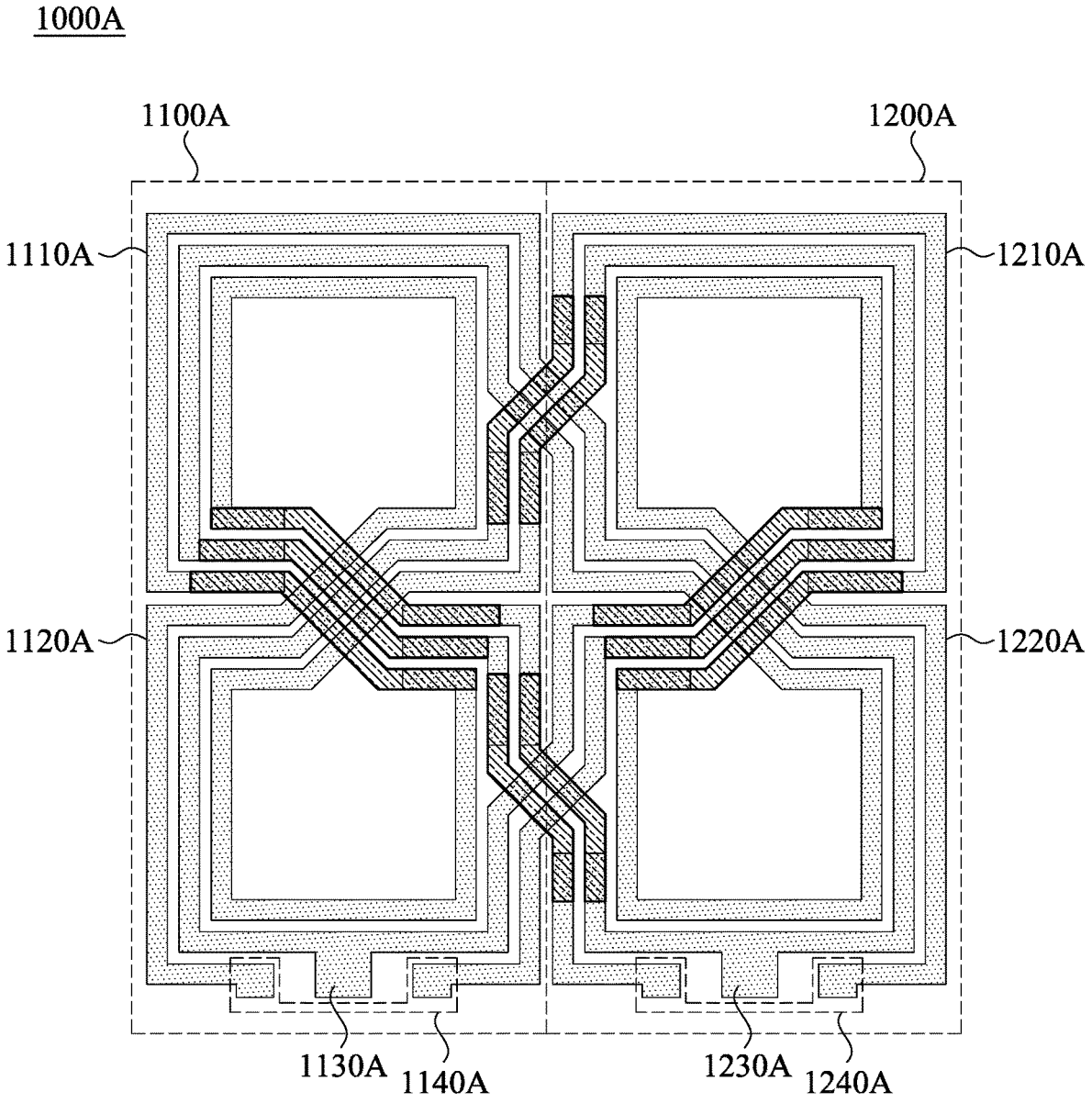
FIG. 2 is a schematic diagram of an inductor device according to some embodiments of the present disclosure.

FIG. 2 is a schematic diagram of an inductor device 1000A according to some embodiments of the present disclosure. Compared to the inductor device 1000 in FIG. 1, the first center tap 1130A and the first input terminal 1140A of the first inductor 1100A of the inductor device 1000A herein are disposed at the same side. In addition, the second center tap 1230A and the second input terminal 1240A of the second inductor 1200A are disposed at the same side. In other words, the first center tap 1130A and the first input terminal 1140A of the first inductor 1100A and the second center tap 1230A and the second input terminal 1240A of the second inductor 1200A are all disposed at the same side. Besides, the difference of the inductor device 1000A and the inductor device 1000 in FIG. 1 is that the first input terminal 1140A of the first inductor 1100A is disposed at an outer side of the second winding 1120A, and the second input terminal 1240A of the second inductor 1210A is disposed at an outer side of the fourth winding 1220A. In addition, the first center tap 1130A of the first inductor 1100A is disposed at an outer side of the second winding 1120A, and the second center tap 1230A of the second inductor 1210A is disposed at an outer side of the fourth winding 1220A. In view of above, since the inductor device 1000A in FIG. 2 adopts two 8-shaped inductors which are disposed with each other side by side, the impact to the quality factor of the inductor device 1000A, which is introduced by the coupling phenomenon from every direction, can be reduced.

Figure 3:
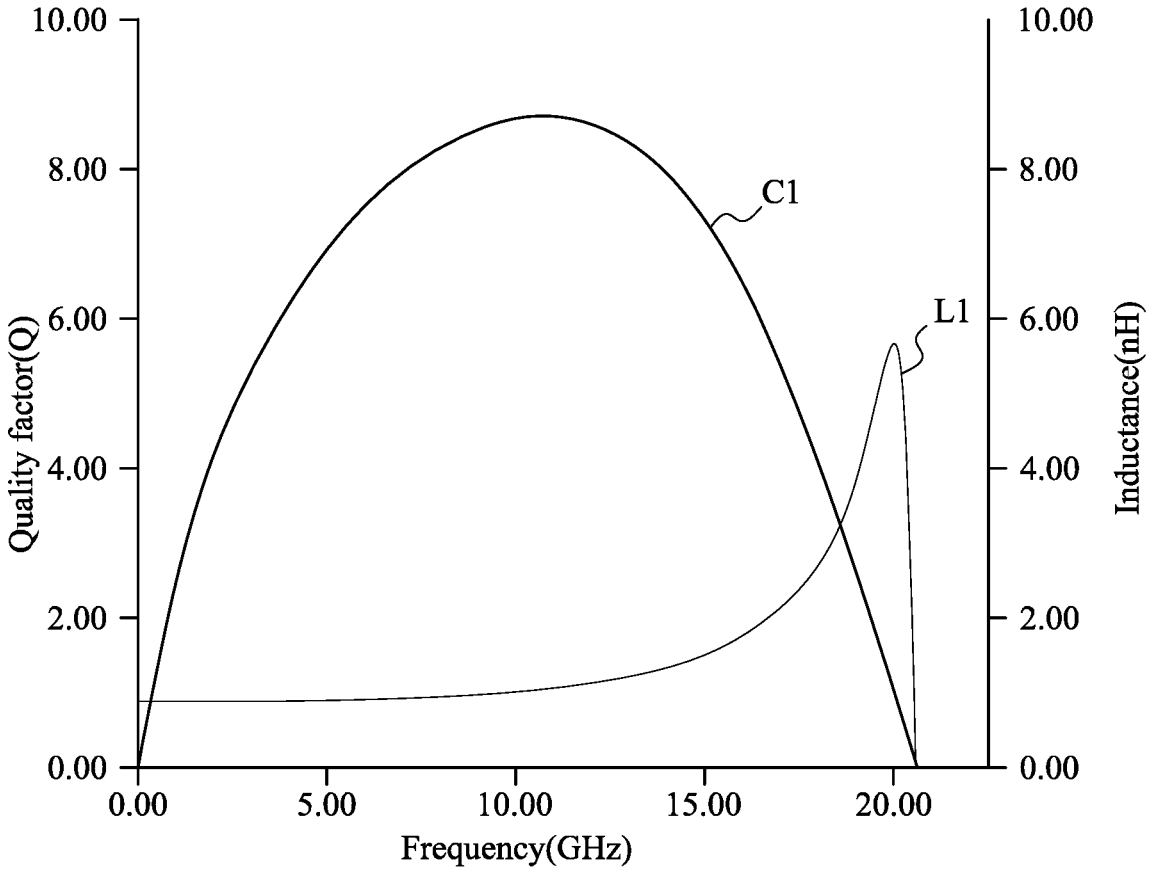
FIG. 3 depicts an experimental data diagram of an inductor device according to some embodiments of this disclosure.

FIG. 3 depicts an experimental data diagram of the inductor device 1000 as shown in FIG. 1 according to some embodiments of this disclosure. As shown in the figure, the curve C1 is a curve line that shows the quality factor (Q) of the inductor device which adopts the structure configuration of the present disclosure, and the curve L1 is a curve line that shows the inductance of the inductor device which adopts the structure configuration of the present disclosure. It is thus known from the experimental data shown in FIG. 3 that the quality factor of the inductor device 1000 is better. For example, the best quality factor of the inductor device 1000 can be about 9. In addition, the quality factor of the curve C1 is 7 and the inductance of the curve L1 is 0.9 nH when the frequency is 5 GHz.

Figure 4:
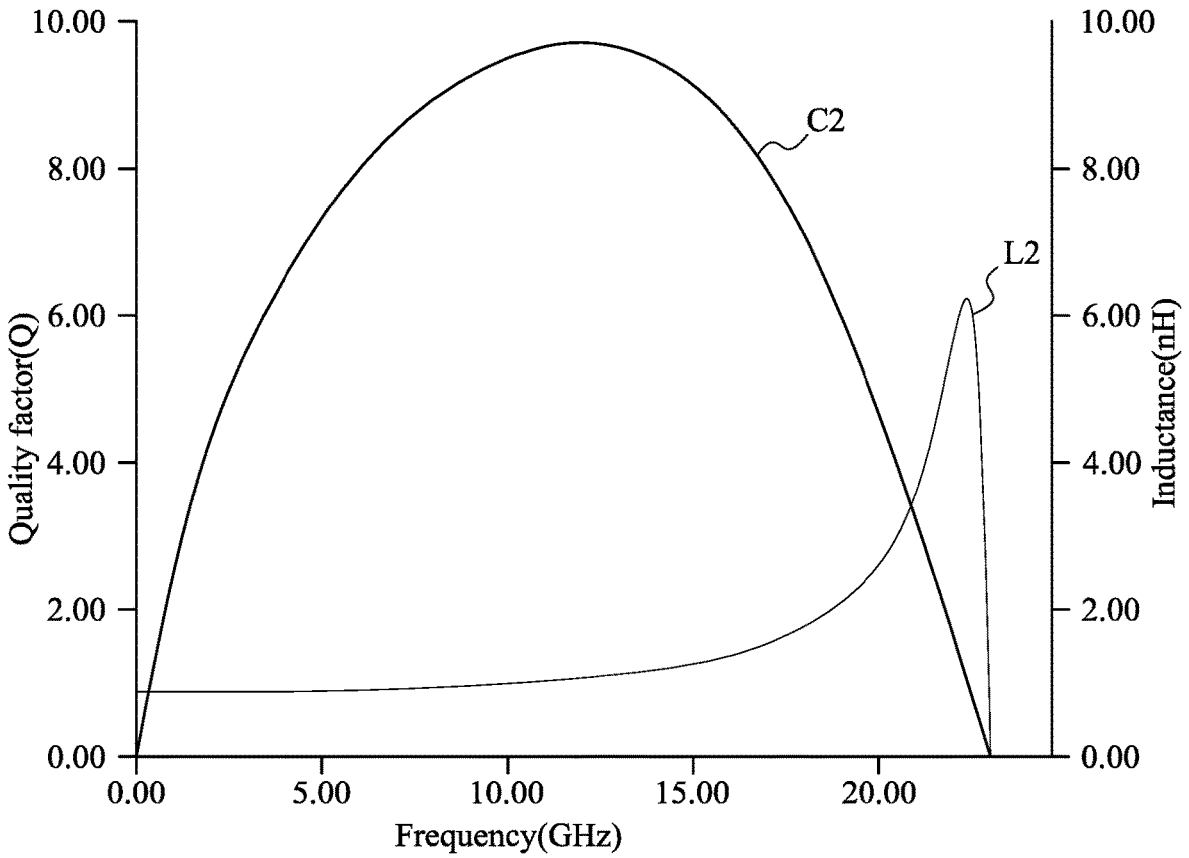
FIG. 4 depicts an experimental data diagram of an inductor device according to some embodiments of this disclosure.

FIG. 4 depicts an experimental data diagram of the inductor device 1000A as shown in FIG. 2 according to some embodiments of this disclosure. As shown in the figure, the curve C2 is a curve line that shows the quality factor (Q) of the inductor device which adopts the structure configuration of the present disclosure, and the curve L2 is a curve line that shows the inductance of the inductor device which adopts the structure configuration of the present disclosure. It is thus known from the experimental data shown in FIG. 4 that the quality factor of the inductor device

1000A is better. For example, the best quality factor of the inductor device 1000A can be about 10. In addition, the quality factor of the curve C2 is 7 and the inductance of the curve L2 is 0.9 nH when the frequency is 5 GHz.

In view of the above embodiments of the present disclosure, it is apparent that the application of the present invention has the advantages as follows. Embodiments of the present disclosure provide an inductor device so that the impact to the quality factor of the inductor device, which is introduced by the coupling phenomenon from every direction (i.e., X, Y directions), can be reduced, and the configuration of the input terminal and the center tap in the inductor device can be arranged flexibly so that the design and the manufacture of the inductor device can be convenient.

What is claimed is:

1. An inductor device comprising:

a first inductor having a first winding and a second winding; and a second inductor having a third winding and a fourth winding, disposed adjacent to the first inductor and coupled to the first inductor in an interlaced manner, wherein each of the first winding, the second winding, the third winding and the fourth winding is winded to form a plurality of wires, and wherein the first inductor further comprises a first input terminal, and the second inductor further comprises a second input terminal, and the first input terminal is coupled to an innermost wire of the plurality of wires of the second winding, and the second input terminal is coupled to an innermost wire of the plurality of wires of the fourth winding.

2. The inductor device of claim 1, wherein the first winding and the third winding are coupled to each other at a first side of the inductor device in an interlaced manner, and the second winding and the fourth winding are coupled to each other at a second side of the inductor device in an interlaced manner, wherein a position of the first side is relative to a position of the second side.

3. The inductor device of claim 2, wherein the position of the first side is opposite to the position of the second side.

4. The inductor device of claim 3, wherein the first winding and the second winding of the first inductor are coupled to each other in an interlaced manner, and the third winding and the fourth winding of the second inductor are coupled to each other in an interlaced manner.

5. The inductor device of claim 4, wherein the first inductor further comprises a first center tap, and the second inductor further comprises a second center tap, wherein the first center tap of the first inductor and the second center tap of the second inductor are disposed at the first side.

6. The inductor device of claim 5, wherein the first center tap of the first inductor is coupled to an inner side of the first winding, and the second center tap of the second inductor is coupled to an inner side of the third winding.

7. The inductor device of claim 5, wherein the first center tap of the first inductor is coupled to an outer side of the second winding, and the second center tap of the second inductor is coupled to an outer side of the fourth winding.

8. The inductor device of claim 5, wherein the first input terminal of the first inductor and the second input terminal of the second inductor are disposed at the second side.

9. The inductor device of claim 8, wherein the first input terminal of the first inductor and the first center tap are disposed at the same side.

10. The inductor device of claim 8, wherein the second input terminal of the second inductor and the second center tap are disposed at the same side.

11. The inductor device of claim 8, wherein the first input terminal of the first inductor and the first center tap, the second input terminal of the second inductor and the second center tap are disposed at the same side.

12. The inductor device of claim 8, wherein the wires of the first winding and the wires of the second winding are coupled to each other in an interlaced manner.

13. The inductor device of claim 12, wherein the wires of the third winding and the wires of the fourth winding are coupled to each other in an interlaced manner.

14. The inductor device of claim 13, wherein a portion of the first winding of the first inductor and a portion of the third winding of the second inductor are coupled to each other in an interlaced manner.

15. The inductor device of claim 14, wherein a portion of the second winding of the first inductor and a portion of the fourth winding of the second inductor are coupled to each other in an interlaced manner.

16. The inductor device of claim 15, wherein directions of currents of two of the first winding, the second winding, the third winding and the fourth winding, which are disposed at the same side, are opposite to each other.

17. The inductor device of claim 16, wherein directions of currents of the first winding and the second winding are opposite to each other, and directions of currents of the third winding and the fourth winding are opposite to each other.

18. The inductor device of claim 17, wherein directions of currents of the first winding and the third winding are opposite to each other, and directions of currents of the second winding and the fourth winding are opposite to each other.

* * * * *